US009272817B2

(12) United States Patent
Becker et al.

(10) Patent No.: US 9,272,817 B2
(45) Date of Patent: Mar. 1, 2016

(54) LIQUID-DISPENSING SYSTEMS WITH INTEGRATED AERATION

(71) Applicants: Nicholas Becker, Seattle, WA (US); Travis Thurber, Seattle, WA (US)

(72) Inventors: Nicholas Becker, Seattle, WA (US); Travis Thurber, Seattle, WA (US)

(73) Assignees: Nicholas Becker, Seattle, WA (US); Travis Thurber, Seattle, WA (US)

( * ) Notice: Subject to any disclaimer, the term of this patent is extended or adjusted under 35 U.S.C. 154(b) by 0 days.

(21) Appl. No.: 13/631,532

(22) Filed: Sep. 28, 2012

(65) Prior Publication Data

US 2014/0091107 A1 Apr. 3, 2014

(51) Int. Cl.

| | |
|---|---|
| ***B67D 7/76*** | (2010.01) |
| ***B65D 25/40*** | (2006.01) |
| ***B65D 47/32*** | (2006.01) |
| ***B65D 51/16*** | (2006.01) |
| ***B65D 85/72*** | (2006.01) |
| ***B01F 5/04*** | (2006.01) |
| ***B01F 3/04*** | (2006.01) |

(52) U.S. Cl.

CPC ..... *B65D 25/40* (2013.01); *B01F 3/04503* (2013.01); *B01F 5/0428* (2013.01); *B65D 47/32* (2013.01); *B65D 51/1683* (2013.01); *B65D 85/72* (2013.01); *B01F 2005/0435* (2013.01); *B01F 2215/0072* (2013.01)

(58) Field of Classification Search

CPC ..... B65D 25/40; B65D 47/32; B65D 47/06; B65D 51/1683; B65D 85/72; B01F 5/0428; B01F 3/04503; B01F 3/0446; B01F 2005/0435; B01F 2215/0072; B01F 13/002; B67D 1/0079

USPC ..... 222/190, 478, 481–484, 144.5, 145.5, 222/145.7, 544; 239/428.5, 413, 414, 416, 239/416.3, 443, 446–447; 261/62, 64.1, 71

See application file for complete search history.

(56) References Cited

U.S. PATENT DOCUMENTS

| | | | | | |
|---|---|---|---|---|---|
| 2,797,906 | A | * | 7/1957 | Aghnides | 261/76 |
| 2,816,746 | A | * | 12/1957 | Botnick | 261/64.1 |
| 3,031,147 | A | * | 4/1962 | Goodrie | 239/428.5 |
| 3,141,619 | A | * | 7/1964 | Benjamin et al. | 239/428.5 |
| 3,341,132 | A | * | 9/1967 | Parkison | 239/443 |
| 3,358,934 | A | * | 12/1967 | Moen | 239/443 |
| 3,477,689 | A | * | 11/1969 | Berghoefer | 251/149.9 |
| 3,533,554 | A | * | 10/1970 | Mongerson | 239/27 |
| 3,778,038 | A | * | 12/1973 | Eversole et al. | 261/50.1 |
| 3,802,606 | A | * | 4/1974 | Gust | 222/484 |
| 4,408,701 | A | * | 10/1983 | Jeans | 222/185.1 |
| 5,323,832 | A | * | 6/1994 | Burrows | 222/1 |
| 5,360,144 | A | * | 11/1994 | Slade | 222/134 |

(Continued)

*Primary Examiner* — Paul R Durand
*Assistant Examiner* — Randall Gruby
(74) *Attorney, Agent, or Firm* — Olympic Patent Works PLLC

(57) ABSTRACT

Liquid-dispensing systems that include integrated aeration systems to aerate a liquid while the liquid is being dispensed are described. Integrated aeration systems enable seamless aeration of a liquid during dispensing. In one aspect, a liquid-dispensing system includes a liquid-conditioning dispenser with an integrated aeration system composed of one or more channels that convey a fluid to mix with a liquid as the liquid is dispensed. The aeration system also includes an aeration switch used to open and close the channels and regulate the amount of the fluid that mixes with the liquid. The liquid-dispensing system also includes a pump and control system to apply pressure on a reservoir that contains the liquid. The pressure forces the liquid from the reservoir to the dispenser via a liquid supply line.

4 Claims, 19 Drawing Sheets

(56) References Cited

U.S. PATENT DOCUMENTS 6,994,276 B2 * 2/2006 Faye ..... B01F 5/0413 239/135
8,251,352 B2 * 8/2012 Chiorazzi ..... B01F 3/0446 222/190
8,297,483 B2 * 10/2012 Korakh ..... B65D 49/04 222/188
8,365,964 B2 * 2/2013 Federighi ..... B01F 3/0446 222/190
8,517,350 B2 * 8/2013 Tsai ..... B01F 5/0428 222/190
8,727,324 B2 * 5/2014 Borden ..... B01F 5/0428 222/190
8,845,178 B2 * 9/2014 Hanada ..... B01F 3/0865 137/888
2005/0111298 A1 * 5/2005 Lott ..... B01F 3/12 366/163.2
2013/0153685 A1 * 6/2013 Michael ..... B01F 5/0428 239/428.5
2014/0352698 A1 * 12/2014 Kim ..... B05B 7/0425 128/205.29
2015/0283522 A1 * 10/2015 Casper ..... B01F 3/04439 426/474

* cited by examiner

LIQUID-DISPENSING SYSTEMS WITH INTEGRATED AERATION

TECHNICAL FIELD

Liquid-dispensing systems, and, in particular, liquid-dispensing systems that include aeration systems.

BACKGROUND

Aeration is a process by which air is circulated through, mixed with or dissolved in a liquid or substance. Various aeration techniques have been used to oxidize, reduce, evaporate or change certain compounds found in liquids. For example, tannins are the chemicals that make wine astringent. In older wines, tannins break down in the bottle as the wine ages, but in younger wines tannins can mask some of a wine's more delicate and sought after flavors. Aerating a younger wine for a period of time causes the tannins to break down and lessens the astringency. Although most wines improve with as little as 15-20 minutes of aeration time, young wines typically have high tannin levels and may need more time to aerate before enjoying. For example, a young cabernet sauvignon may need about an hour of aeration for flavor softening. Aeration can also be used to evaporate other volatile and undesirable compounds in a beverage while retaining desirable ones. In particular, there are a number of compounds that are reduced with aeration, such as sulfites, which are added to certain beverages to prevent oxidation and microbial activity but produce unpleasant smells.

Typical approaches to reduce aeration time include use of fountains, cascades, paddle-wheels or cones. However, these aeration devices are often inconvenient to use, require additional expense and clean-up time, and cannot be fine tuned to provide a desired level of aeration. For example, dispensing a boxed wine with a typical aerator requires one hand to hold a glass, another hand to press the dispensing button on a spigot, and a third hand to hold an aerator located between the glass and the spigot, which is inconvenient for practical use. As a result, beverage distributors and manufactures continue to seek systems that enable convenient beverage aeration, control over the amount of air a beverage is combined with and reduce the aeration time.

DETAILED DESCRIPTION

Liquid-dispensing systems that include integrated aeration systems to aerate a liquid while the liquid is being dispensed are described. The liquid can be a beverage, such as wine, whose flavors improve by combining the liquid with air, a gas or another liquid. By integrating an aeration system into a liquid-dispensing system, the liquid can be seamlessly aerated during dispensing, which reduces the time typically used to aerate the liquid. In one aspect, a liquid-dispensing system includes a liquid-conditioning dispenser integrated with an aeration system composed of one or more channels embedded within the dispenser that convey air, a gas, or another liquid to mix with the liquid dispensed from the dispenser. The aeration system also includes an aeration switch used to open and close the channels and regulate the amount of air, gas or other liquid that mixes with the liquid.

In the following description, various aeration systems of liquid-conditioning dispenser embodiments are described in terms of aerating a liquid with air. However, it should be noted that the liquid-conditioning dispensers, and, in particular, the various aeration systems, described below are not intended to be limited to air as the only kind of fluid a liquid to be dispensed can be mixed with. The aeration systems can be used to mix a liquid to be dispensed with other types of fluids including air, a gas, and another liquid.

Figure 1A:
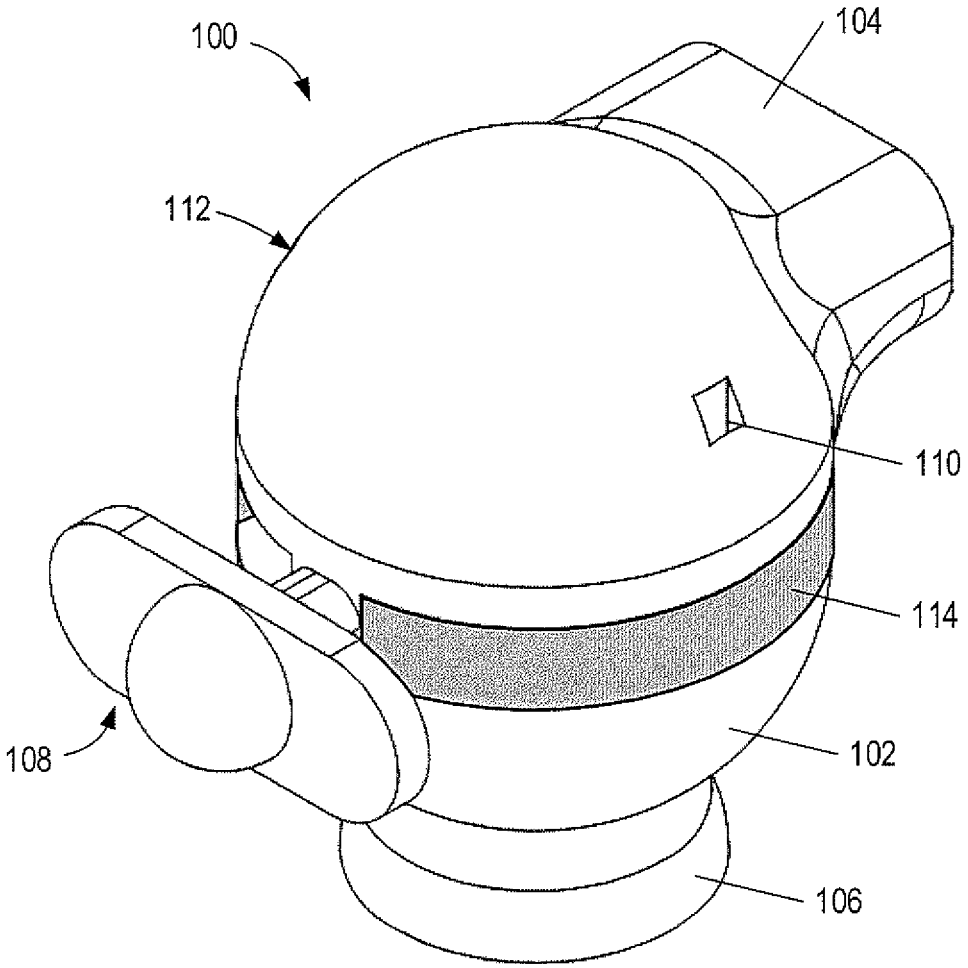
FIG. 1A shows an isometric view of an example liquid-conditioning dispenser.
Figure 1D:
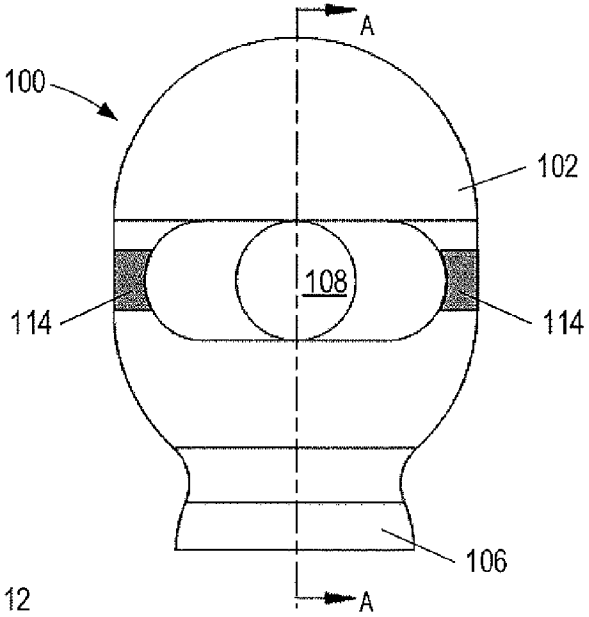
FIGS. 1B-1D show two side-elevation views and a top view of the dispenser shown in FIG. 1A.
Figure 1C:
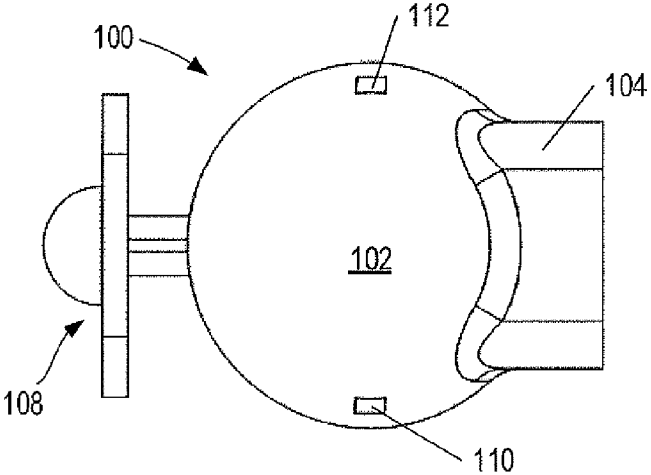
Figure 1B:
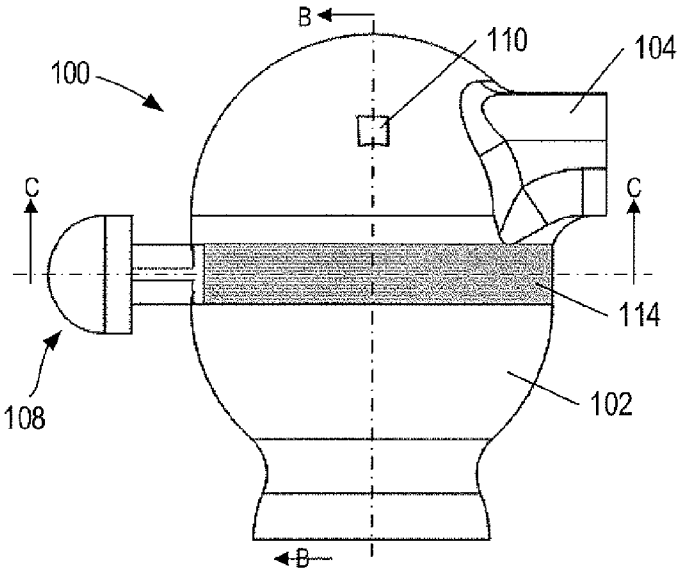

FIG. 1A shows an isometric view of an example liquid-conditioning dispenser 100, and FIGS. 1B-1D show a first side elevation view, a second side elevation view, and a top view, respectively, of the dispenser 100. As shown in the various views, the dispenser 100 includes a tap composed of a body 102, a tap connector 104, a spout 106, and a valve handle 108. The body 102 of the tap has a dome-shaped top that smoothly transitions to a cylindrical wall that, in turn, smoothly transitions to the spout 106. The dispenser 100 also includes an integrated aeration system composed of two channels with openings 110 and 112 located opposite one another in the dome-shaped top of the body 102 and an aeration switch 114 embedded within the cylindrical wall of the body 102. As shown in FIGS. 1A and 1B, the aeration switch 114 is located within a slot that partially wraps around the cylindrical wall of the body 102.

Figure 2B:
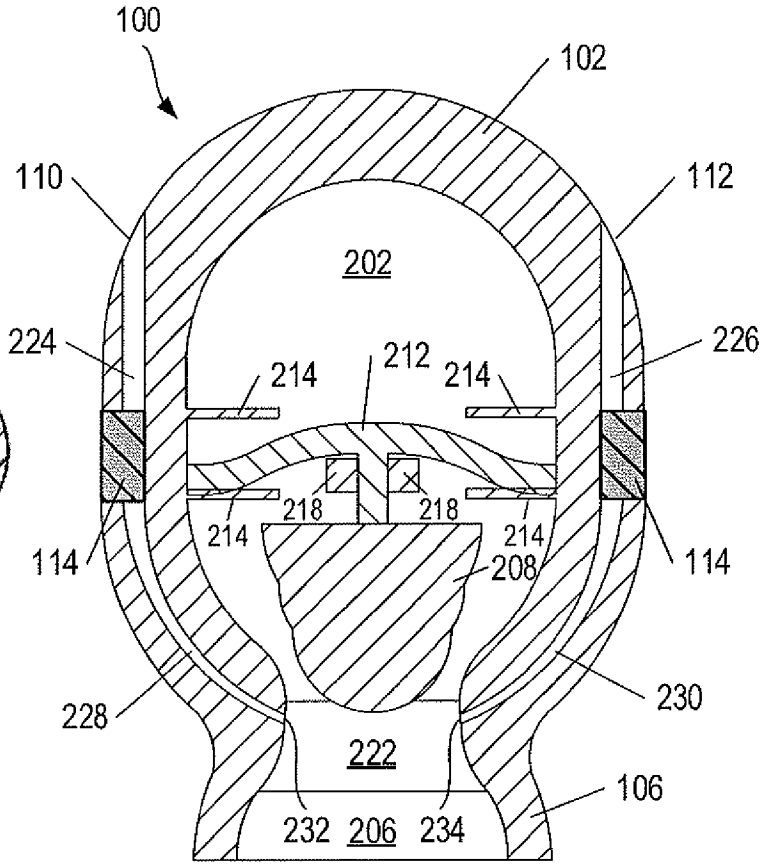
FIGS. 2A-2B show two different cross-sectional views of the dispenser shown in FIG. 1.
Figure 2A:
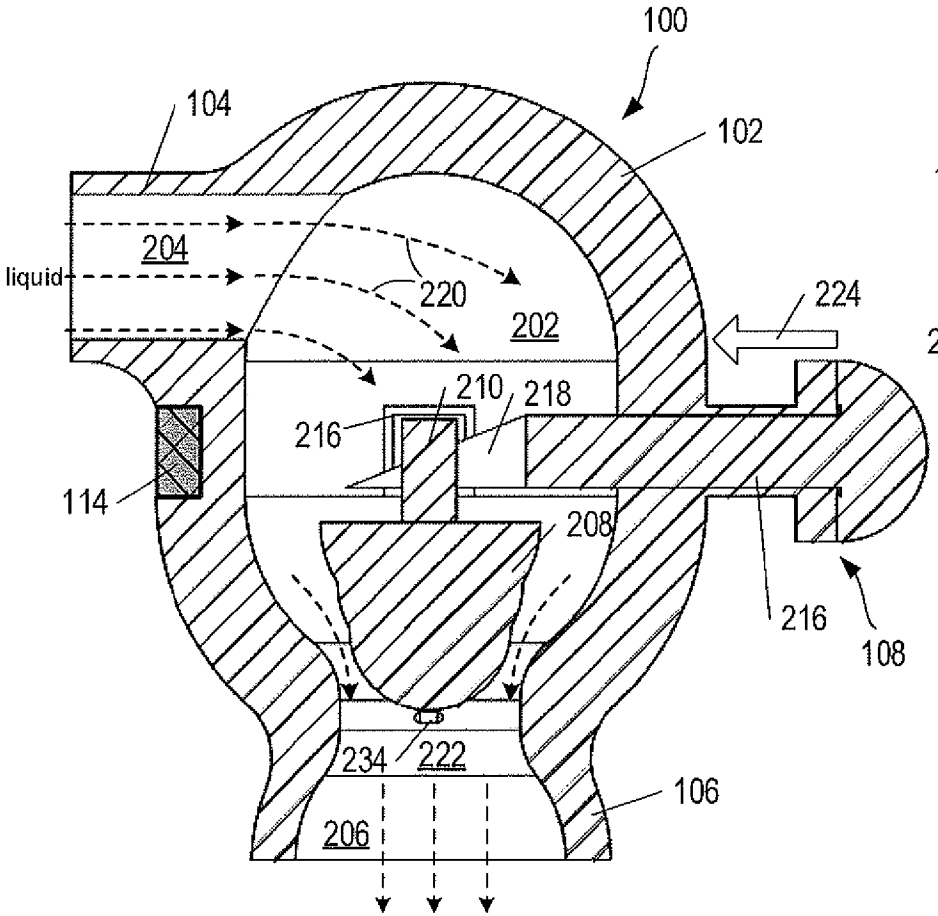

FIG. 2A shows a first cross-sectional view of the dispenser 100 interior along a line A-A shown in FIG. 1D, and FIG. 2B shows a second cross-sectional view of the dispenser 100 interior along a line B-B shown in FIG. 1B. As shown in FIGS. 2A-2B, the body 102 includes a hollow interior cavity 202. FIG. 2A reveals that the cavity 202 transitions to a connector opening 204 in the tap connector 104 and transitions to a spout opening 206 in the spout 106. FIGS. 2A-2B also reveal the components of an example valve of the dispenser 100 used to control dispensation of a liquid. As shown in FIG. 2B, the example valve comprises an inverted bell-shaped stopper 208 connected to a post 210 suspended from a support beam 212 that spans the inner diameter of the cavity 202. The beam 212 is supported by shelves 214 that extend into the cavity 202 from the interior walls of the body 102. The valve handle 108 is attached to a pin 216 that passes through an opening in the cylindrical wall of the body 102. The end of the pin 216 opposite the handle 108 is forked with two angled tines 218 that straddle the post 210, as shown in FIG. 2B. In FIG. 2A, dashed directional arrows 220 represent a liquid flowing into the cavity 202 via the opening 204. When no force is applied to the valve handle 108, the liquid entering the cavity 202 pushed down on the stopper 208, which, in turn, pushes the stopper 208 downward into a narrow opening 222 between the cavity 202 and the spout opening 206 thereby forming a liquid-tight sealing engagement with the inner surface of the narrow opening 222. In conjunction with the force of the liquid, the force of the bent beam also pushes the stopper 208 into the liquid-tight position. When no liquid flows into the cavity 202, the stopper 208 sits in the closed position. On the other hand, as the valve handle 108 is pushed inward, as indicated by directional arrow 224, the angled surfaces of the tines 216 drive the support 212 upward, forcing the stopper 208 out of the narrow opening 222 thereby allowing the liquid to exit the dispenser 100 through the spout opening 206. Note that because the tines 216 are angled, the flow rate of the liquid exiting the cavity 202 can be controlled by the distance the pin 216 is pushed into the cavity 202. In other words, the farther the pin 216 is pushed into the cavity, the higher the stopper 208 is lifted out of the opening 222 thereby creating a larger opening through which the liquid can pass to exit the dispenser 100.

FIG. 2B also reveals the components of an example integrated aeration system. The aeration system includes two upper channels 224 and 226 that extend from the openings 110 and 112 within the wall of the body 102 and two lower channels 228 and 230 that extend within the wall of the body 102 to corresponding openings 232 and 234 in the narrow opening 222. The switch 114 is located within a slot, described below with reference to FIG. 3, which separates the upper channels 224 and 226 from the lower channels 228 and 230. As shown in FIG. 2B, the upper channel 224 is aligned with the lower channel 228, and the upper channel 226 is aligned with the lower channel 230. Operation of the switch 114 to control the flow of air through the channels and into the narrow opening 222 is described below with reference to FIGS. 4 and 5.

Figure 3A:
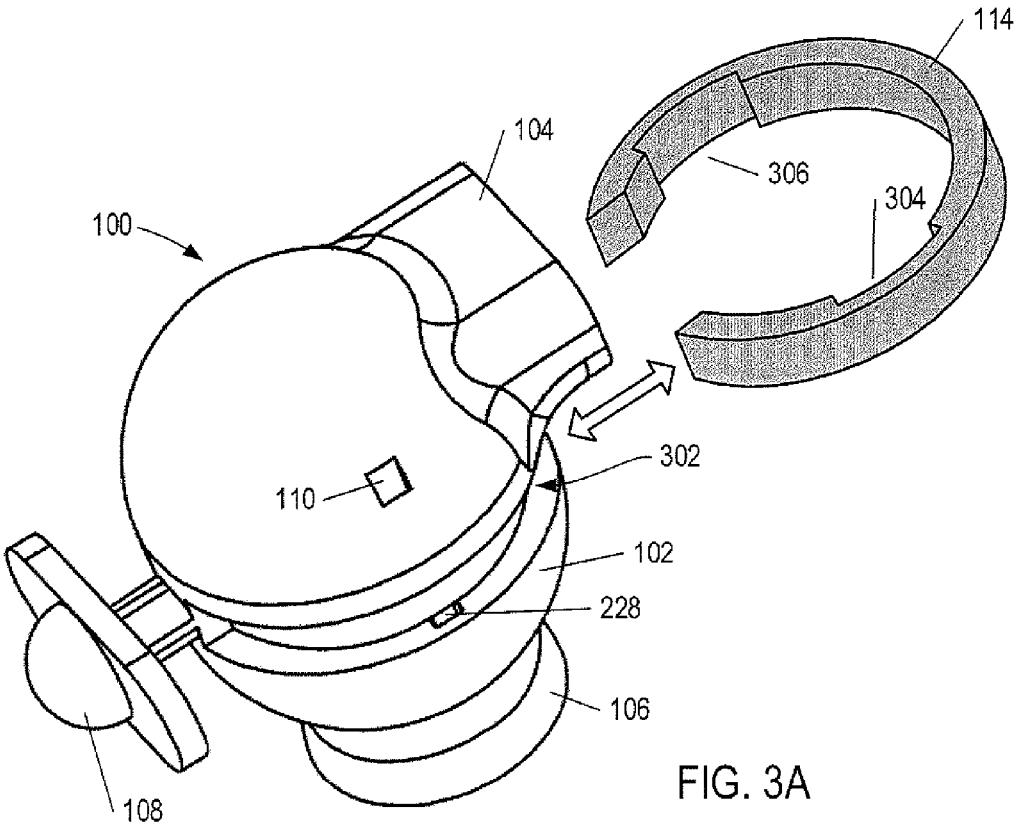
FIG. 3A shows an exploded isometric view of the dispenser shown in FIG. 1 with a switch removed.
Figure 3B:
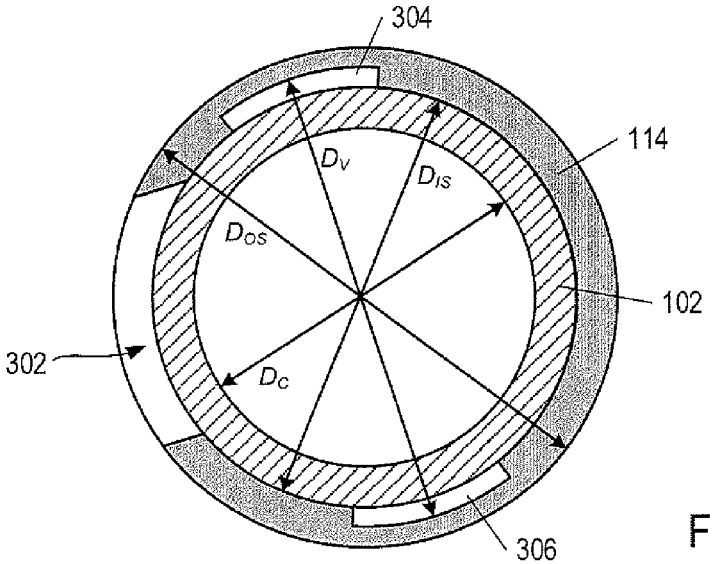
FIG. 3B shows a cross-sectional view of the dispenser shown in FIG. 1C.

FIG. 3A shows an exploded isometric view of the dispenser 100 with the switch 114 removed from a C-shaped slot 302 formed in the cylindrical wall of the body 102. The C-shaped slot 302 separates the upper and lower channels described above. The switch 114 is rotatable within the slot 302 and has an open ring configuration with two vents or notches 304 and 306 formed in the inner surface of the switch 114. FIG. 3B shows a cross-sectional view of the dispenser 100 along a line C-C shown in FIG. 1B and reveals the relative dimensions of the body 102, slot 302, and switch 114. $D_C$ represents the diameter of the cavity 202; $D_{IS}$ represents the inner diameter of the switch 114, which is approximately the same as the outer diameter of the body 102 within the slot 302; $D_V$ represents the diameter of the vents 304 and 306; and $D_{OS}$ represents the outer diameter of the switch, which may be approximately the same as the outer diameter of the cylindrical wall of the body 102. As shown in FIG. 3B, the example dispenser 100 is configured so that $D_C<D_{IS}<D_V<D_{OS}$, where $D_V-D_{IS}$ is the width of the vents 304 and 306 and $D_{OS}-D_{IS}$ is the width of the slot 302.

Figure 4A:
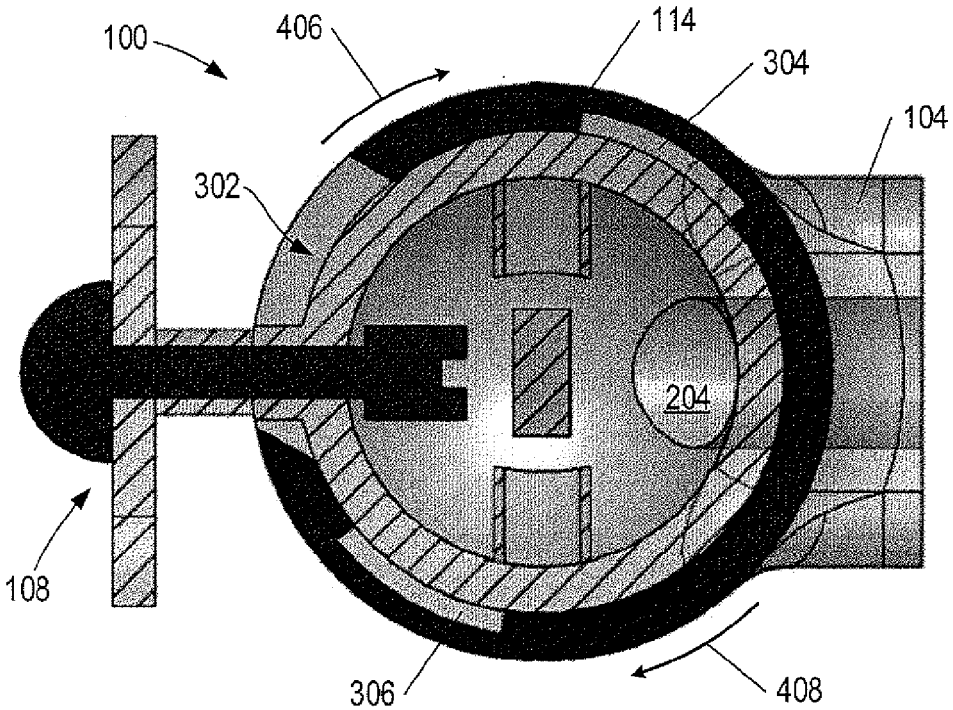
FIGS. 4A-4B show cross-sectional views the dispenser shown in FIG. 3B with a switch in closed and open positions.
Figure 4B:
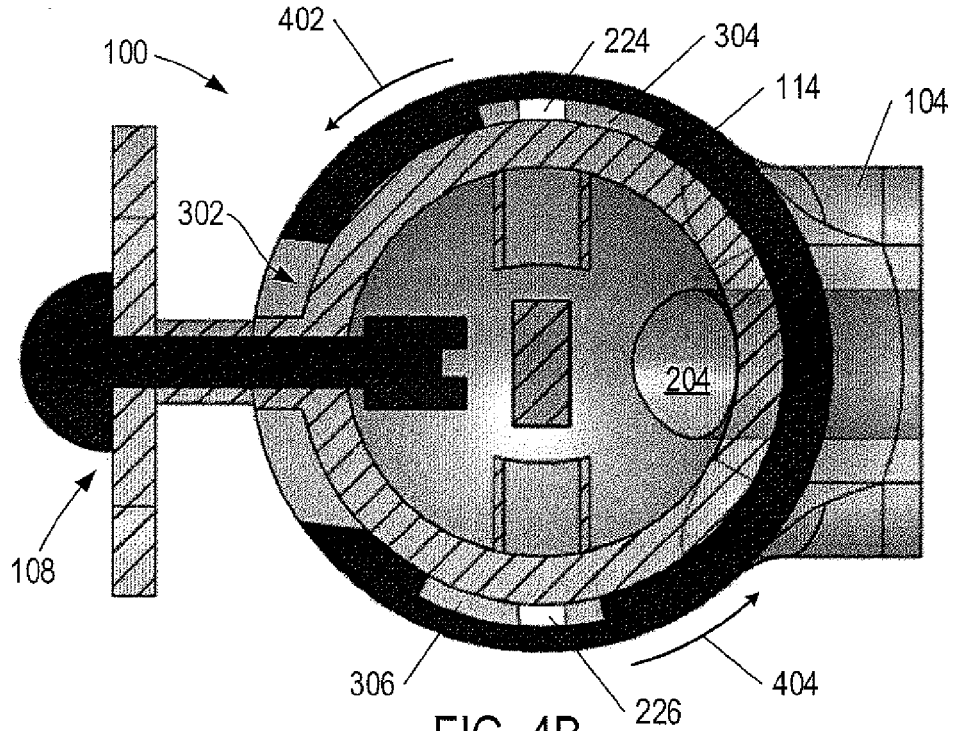

FIGS. 4A-4B show cross-sectional views of the switch 114 in closed and open positions along the line C-C shown in FIG. 1B. In FIG. 4A, the switch 114 is in a closed position in which the wide portions of the switch 114 outside the vents 304 and 306 block the channels, as shown in FIG. 2B. In FIG. 4B, directional arrows 402 and 404 represent rotation of the switch 114 within the slot 302 into an open position so that the vents 304 and 306 allow air to flow from the upper to the lower channels. For example, as shown in FIG. 4B, the switch 114 is rotated so that the channels 224 and 226 are open to air flow. Rotating the switch 114 in the opposite direction, as represented by directional arrows 406 and 408 in FIG. 4A, returns the switch 114 to the closed position.

Figure 5:
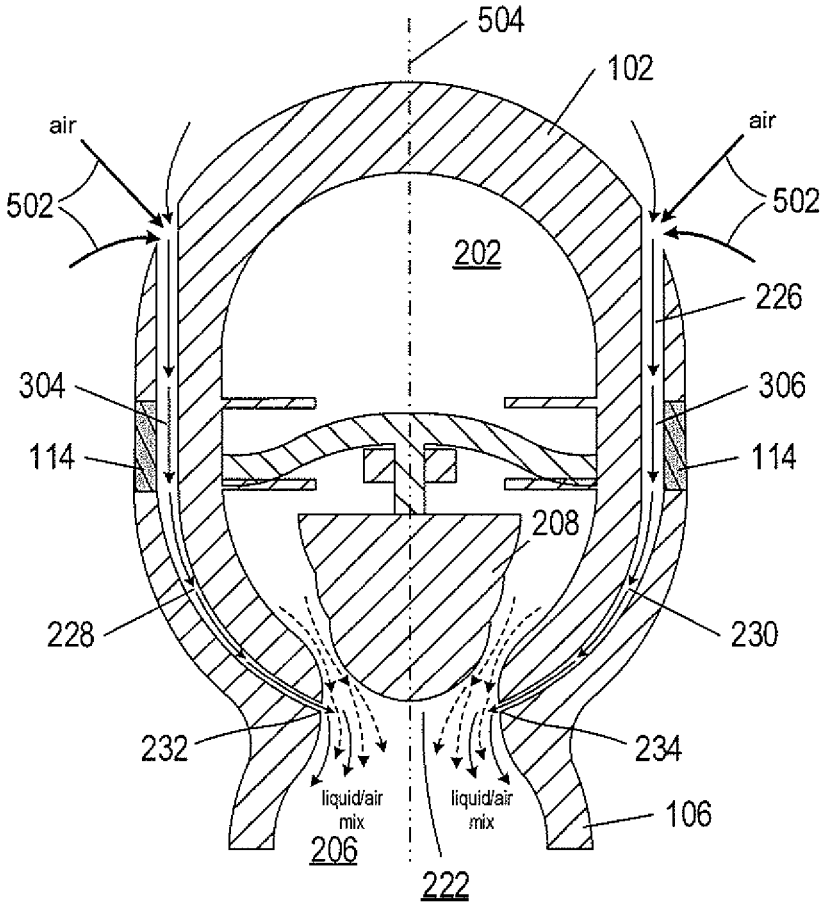
FIG. 5 shows a cross-sectional view of the dispenser shown in FIG. 1B.

FIG. 5 shows a cross-sectional view of the dispenser 100 along the line A-A shown in FIG. 1B. When the switch 114 is rotated into the open position illustrated in FIG. 4B, the vent 304 is aligned with the upper channel 224 and the lower channel 228, and the vent 306 is aligned with the upper channel 226 and the lower channel 230. When the valve handle 108 is depressed to dispense the liquid, as described above with reference to FIG. 2, the stopper 208 is lifted out of the narrow opening 222 so that the liquid can flow out of the cavity 202. As the liquid flows past the openings 232 and 234, air is drawn through the upper and lower channels, as represented by solid directional arrows 502, to mix with the liquid in the narrow opening 222 and the spout opening 206. The vents 304 and 306 are called "axial vents" because the air flows from the upper channels to the lower channels substantially parallel to the central axis 504 of the dispenser 100. When mixing air with the liquid is no longer desired, the switch is rotated to the closed position illustrated in FIG. 4B. As a result, air can no longer freely flow from the upper to the lower channels to mix with the liquid.

Figure 6B:
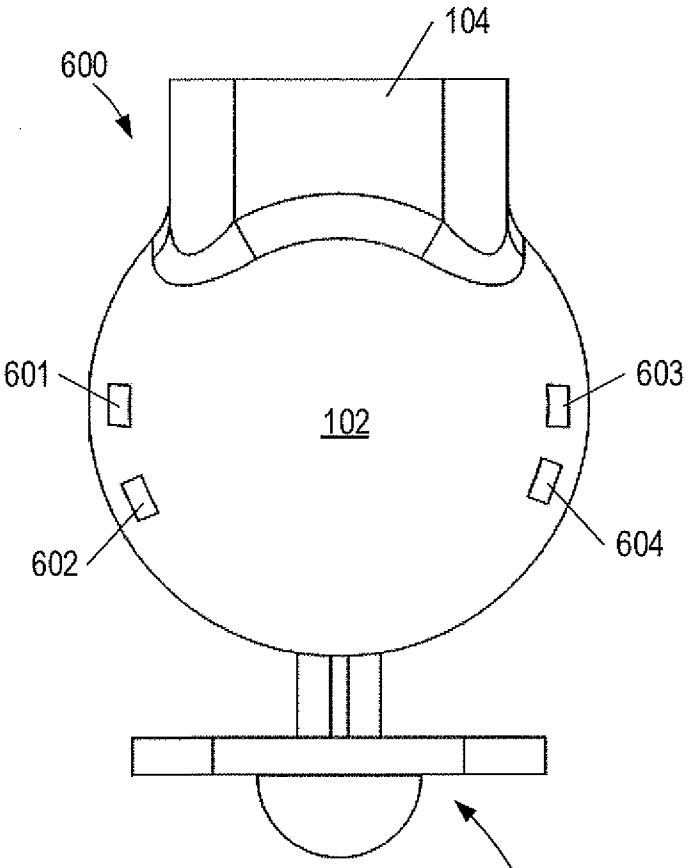
FIGS. 6A-6B show isometric and top views of an example liquid-conditioning dispenser.
Figure 6A:
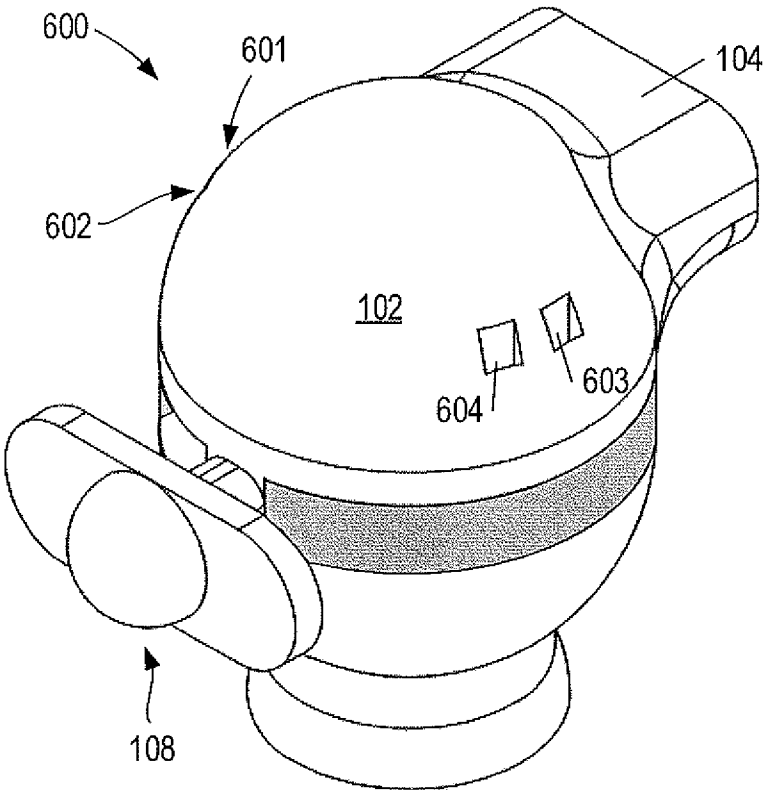

The dispenser 100 described above is not intended to be exhaustive of the many different kinds of liquid-conditioning dispensers, and the aeration system described above represents one of many different ways in which aeration systems can be implemented. For example, aeration systems are not limited to two corresponding upper and lower channels to convey air to mix with a liquid. In other embodiments, the number of corresponding upper and lower channels can range from as few as one upper and one lower aligned channels to any suitable number of aligned upper and lower channels. FIGS. 6A-6B show isometric and top views of an example liquid-conditioning dispenser 600 that is similar to the dispenser 100, except the dispenser 600 includes four upper and lower corresponding channels. The top view in FIG. 6B shows four openings 601-604 in the dome-shaped top of the body 102 that lead to four upper channels and four corresponding lower channels located within the body wall. The four lower channels open into a narrow opening at the base of a cavity of the dispenser 600 in the same manner the two lower channels 228 and 230 open into the narrow opening 222 of the dispenser 100 described above.

Figure 7C:
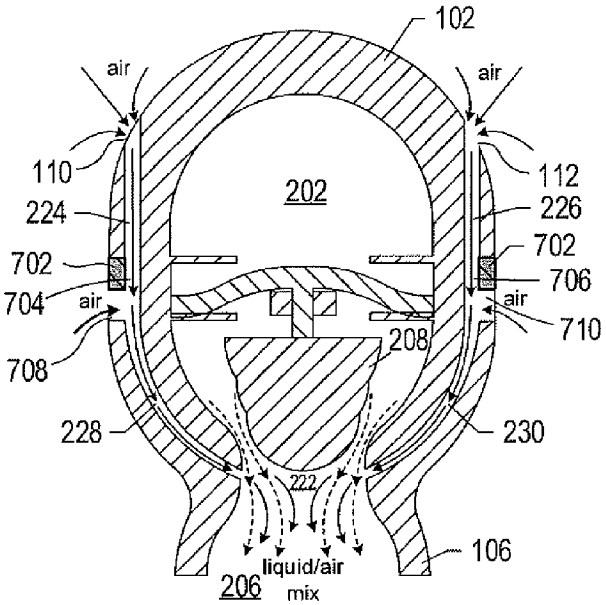
FIGS. 7B-7C show a side elevation and cross-sectional views of a dispenser implemented with the switch shown in FIG. 7A.
Figure 7A:
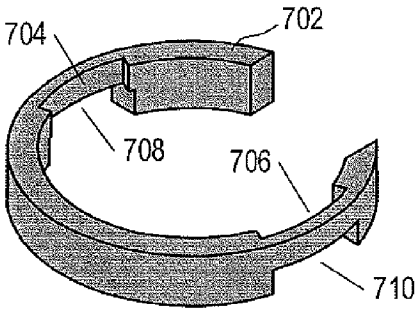
FIG. 7A shows an isometric view of an open-ring switch with axial vents and lateral vents.
Figure 7B:
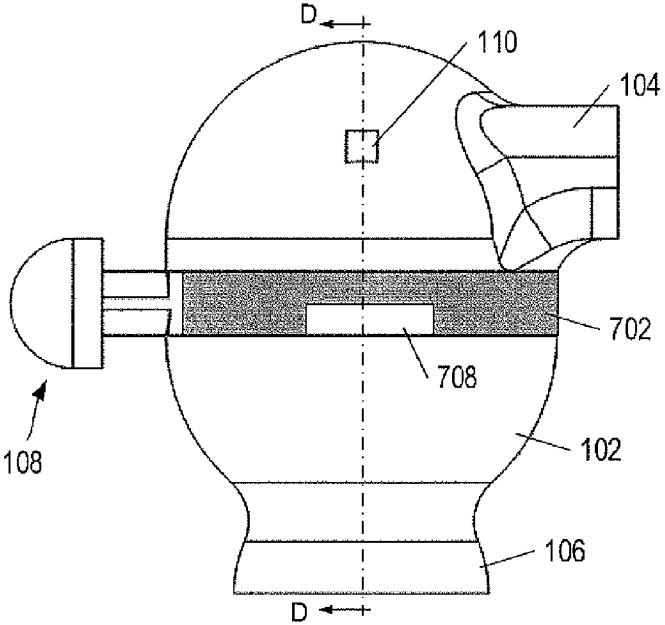

A switch can also be configured with lateral vents to allow air to flow directly into the lower channels. FIG. 7A shows an isometric view of an open-ring switch 702 with axial vents 704 and 706 and lateral vents 708 and 710. FIG. 7B shows a side elevation view of the dispenser 100 with the switch 114 replaced by the switch 702. FIG. 7C shows a cross-sectional view of the dispenser 100 along a line D-D shown in FIG. 7B. The switch 702 is similar to the switch 114 described above in that the switch 702 has axial vents 704 and 706 that direct the air to flow from the upper channels 224 and 226 to the lower channels 228 and 230 as described above for the axial vents 304 and 306. But the switch 702 also includes the lateral vents 708 and 710 that allow air to bypass the upper channels 224 and 226 and flow directly into the lower channels 228 and 230.

Figure 8:
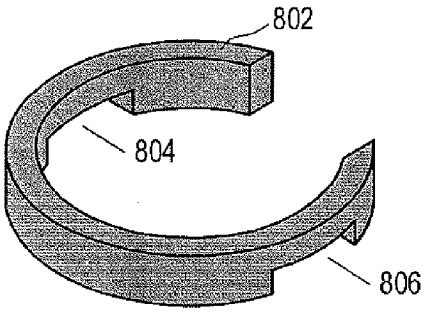
FIG. 8 shows an isometric view of an open-ring switch with lateral vents.

A liquid-conditioning dispenser can be configured similar to the dispenser 100 but with the upper channels 224 and 226 and corresponding openings 110 and 112 omitted. For a liquid-conditioning dispenser configured with the slot 302 and only the lower channels 228 and 230, the open-ring switches 114 and 702 are replaced by an open-ring switch 802 with only lateral vents 804 and 806, as shown in the example illustration of FIG. 8. The lateral vents 804 and 806 allow air to flow directly into the lower channels 228 and 230, as described above with reference to FIG. 7C.

Figure 9A:
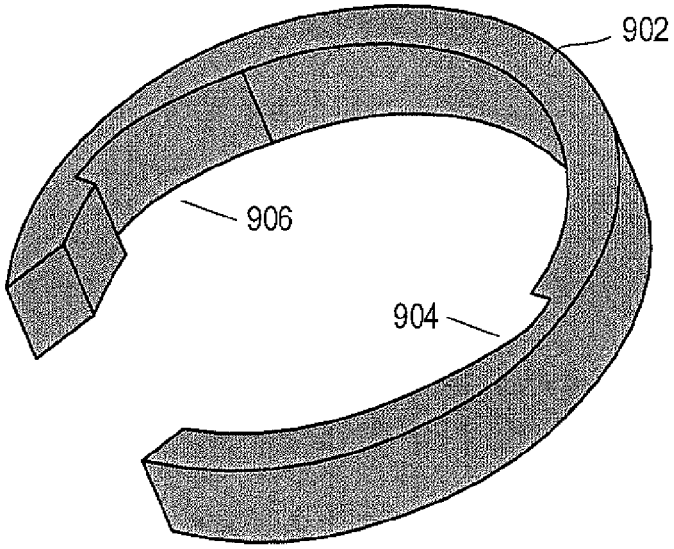
FIG. 9A shows an isometric view of an example open-ring switch with variably controllable vents.
Figure 9B:
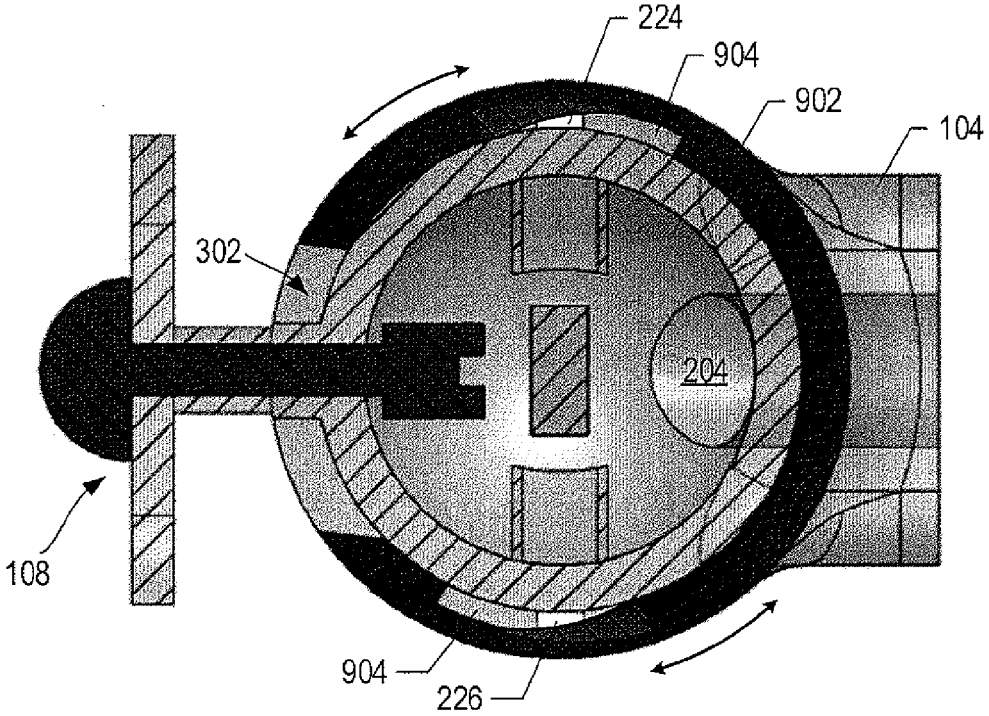
FIG. 9B shows a cross-sectional view of a dispenser implemented with the switch shown in FIG. 9A.

Integrated aeration systems are not intended to be limited to simply open and closed air flow. Aeration systems can have variable switches that allow for regulation of the amount of air that mixes with a liquid dispensed from a dispenser. FIG. 9A shows an isometric view of an example open-ring switch 902 with variably controllable vents 904 and 906. The switch 902 is similar to the switch 114 described above, except the vents 904 and 906 of the switch 902 are angled notches that allow the amount of air that passes through the channels to be regulated. FIG. 9B shows a cross-sectional view of the dispenser 100 along the line C-C shown in FIG. 1B except the switch 114 is replaced by the switch 902. In the example of FIG. 9B, the switch 902 is used to regulate the amount of air that is ultimately combined with the liquid by rotating the switch 902 so that the vents partially obstruct the flow of air from the upper channels 224 and 226.

Figure 10B:
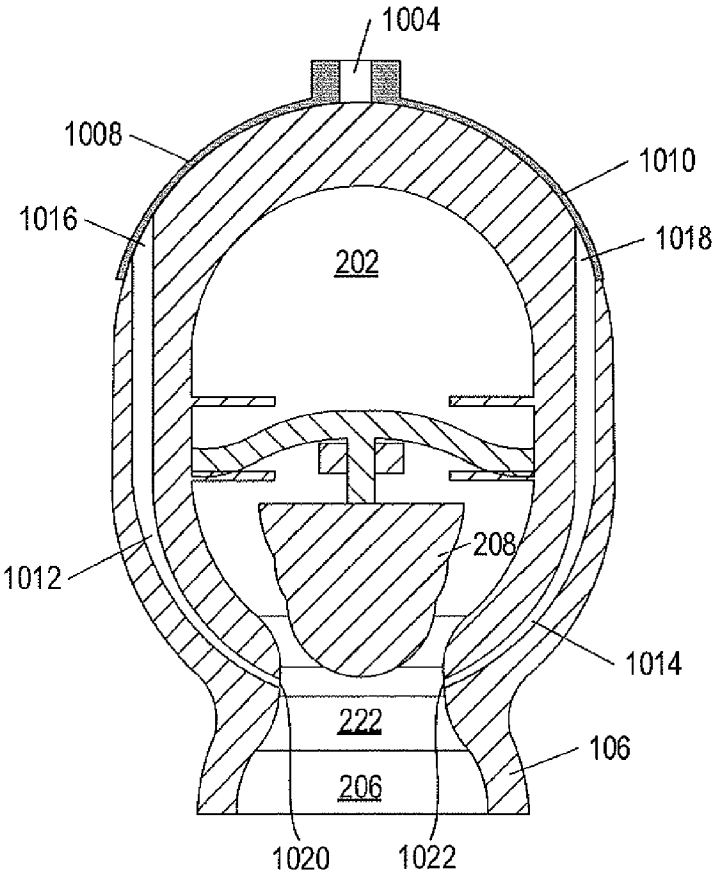
FIGS. 10A-10B show an isometric and cross-sectional view of an example liquid-conditioning dispenser implemented with a blade switch.
Figure 10A:
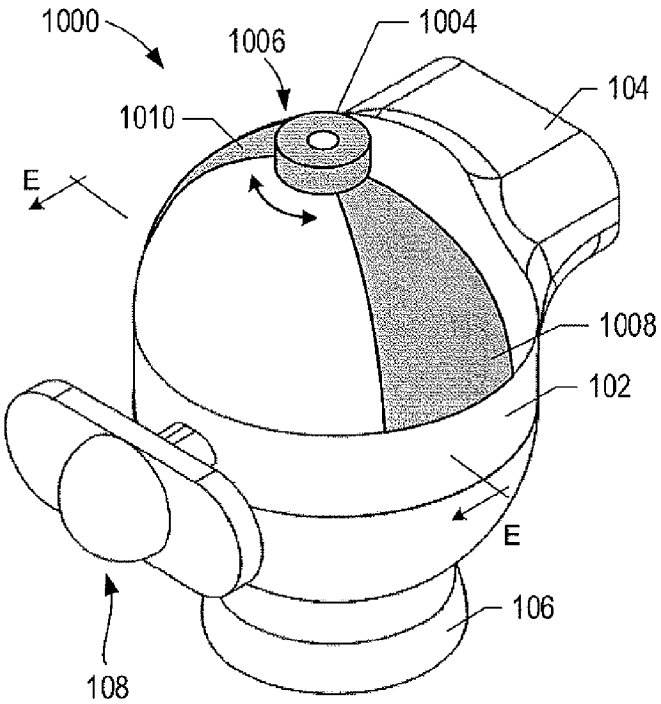

Aeration systems include other kinds of aeration switches and are not intended to be limited to the open-ring switches described above. In other liquid-conditioning dispenser embodiments, a blade switch implemented with curved blades that conform to the dome-shaped top of the tap body are used to control air flow into the channels. FIG. 10A shows an isometric view of an example liquid-conditioning dispenser 1000. The dispenser 1000 is similar to the dispenser 100 in that the dispenser 1000 includes the tap connector 104, the spout 106, and the valve handle 108. Unlike the dispenser 100, the body 1002 of the dispenser 1000 does not have a slot 302 located in the cylindrical wall of the body 1002 to receive an open-ring switch. Instead, the body 1002 has a knob 1004 located at the apex of the dome-shaped top of the body 1002. A rotatable blade switch 1006 configured with two blades 1008 and 1010 that are shaped to conform to the dome-shaped top of the body 1002 is attached to the knob 1004. FIG. 10B shows a cross-sectional view of the example dispenser 1000. The dispenser 1000 includes the same valve system as the dispenser 100 described above, but the body 1002 includes two channels 1012 and 1014 that extend from openings 1016 and 1018 in the dome-shaped top of the body 1002 to openings 1020 and 1022 in the narrow opening 222. The combination of blade switch 1006 and channels 1012 and 1014 are an example of an integrated aeration system. The blades 1008 and 1010 can be rotated to open and closed positions. In FIGS. 10A and 10B, the blades are rotated into a closed position that prevents air from being conveyed to the narrow opening 222 via the channels 1012 and 1014. When the blades are rotated to an open position, air is conveyed to the narrow opening 222 via the channels 1012 and 1014.

Figure 11:
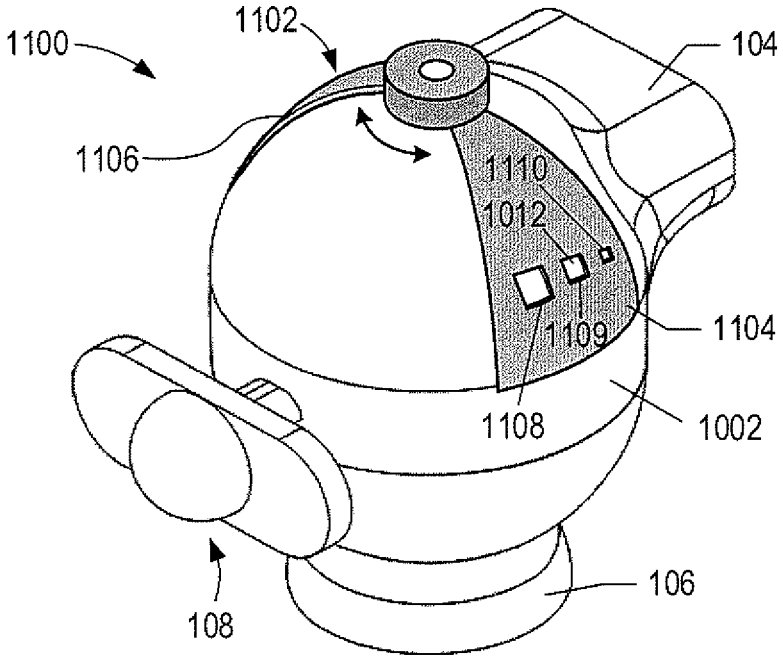
FIG. 11 shows an isometric view of an example liquid-conditioning dispenser implemented with a vented blade switch.
Figure 12:
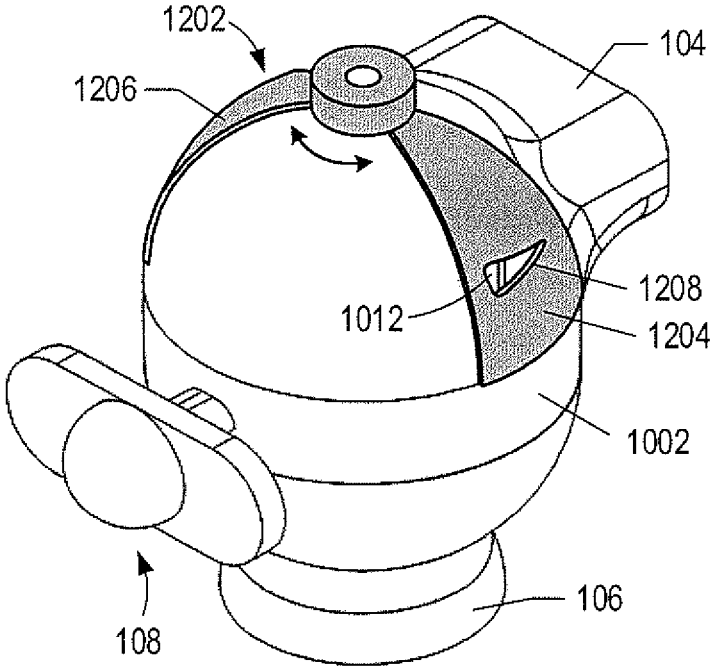
FIG. 12 shows an isometric view of an example liquid-conditioning dispenser implemented with a vented blade switch.

Blade switches can be configured with vents in the blades in order to regulate the amount of air that enters the channels. FIG. 11 shows an isometric view of an example liquid-conditioning dispenser 1100 that includes a rotatable blade switch 1102. The blade switch 1102 is similar to the blade switch 1006 except the blades 1104 and 1106 each have a series of differently sized vents, such as three vents 1108-1110 in the blade 1104. The switch 1102 is operated by positioning one of the vents 1108-1110 over the channel 1012 to regulate the amount air that enters the channel 1012. FIG. 12 shows an isometric view of an example liquid-conditioning dispenser 1200 that includes a rotatable blade switch 1202. The blade switch 1202 is also similar to the blade switch 1006 except the blades 1204 and 1206 each have a single angled vent, such as angled vent 1208. The angled vent 1208 is positioned over the opening to the channel 1012 to regulate the amount air that enters the channel 1012.

Liquid-conditioning dispensers are not intended to be limited to the specific type of liquid-dispensing valve described above with reference to FIGS. 2A and 2B. The liquid-dispensing valve described above is included to represent just one of many different types of valves and is not intended to be exhaustive of the many different types of valves that can be used to implement the liquid-dispensing aspect of a liquid-conditioning dispenser. Liquid-conditioning dispensers can be implemented with other types of hand-operated and electronically operated valves.

Figure 13C:
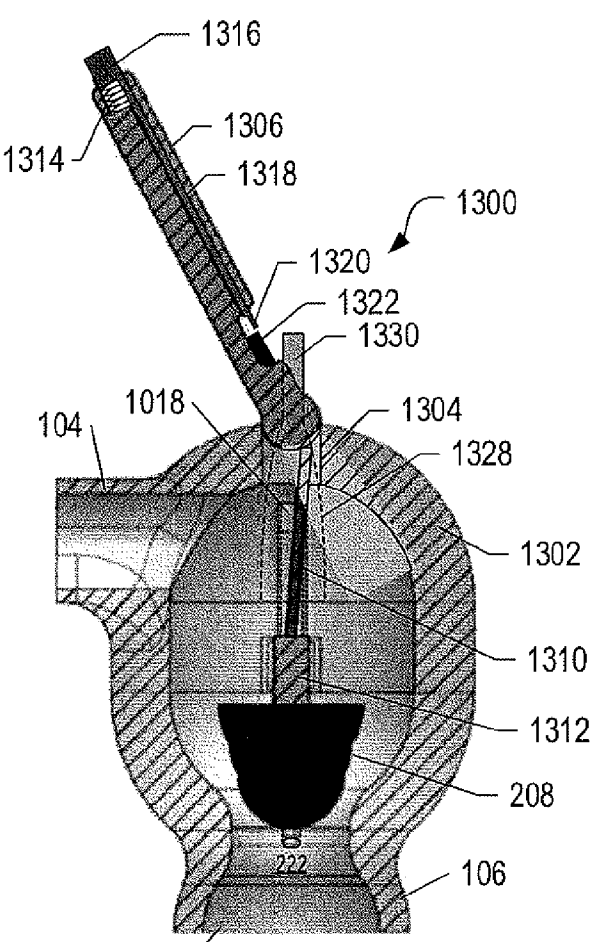
FIGS. 13A-13C show three views of an example liquid-conditioning dispenser with an aeration switch integrated into a valve handle.
Figure 13B:
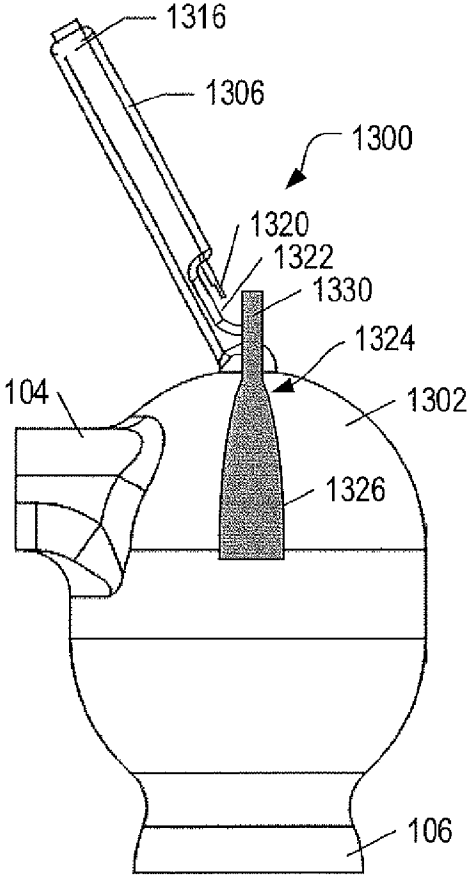
Figure 13A:
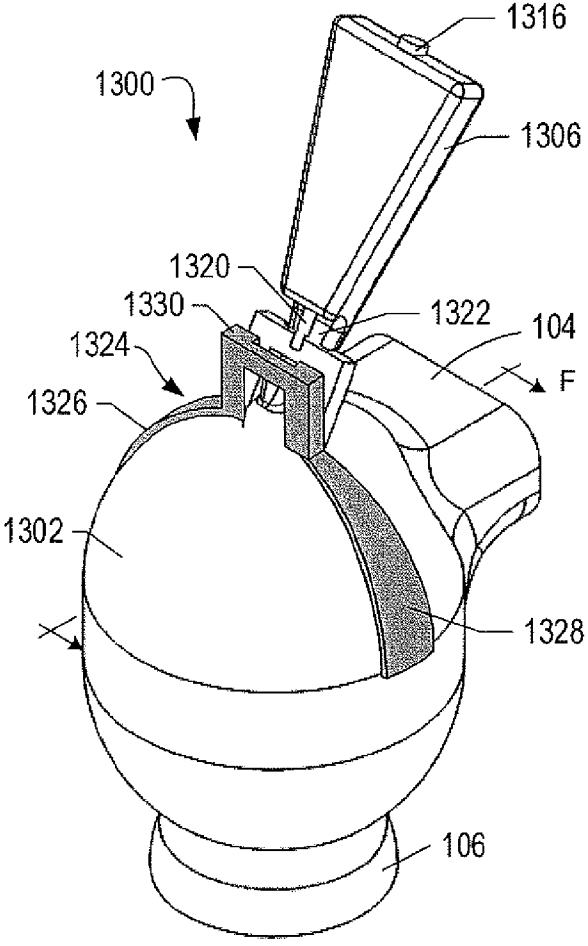

FIGS. 13A-13C show isometric, side elevation, and cross-sectional views, respectively, of an example liquid-conditioning dispenser 1300 with an aeration switch integrated into a valve for dispensing a liquid. The dispenser 1300 is similar to the dispenser 1000, shown in FIG. 10, except the body 1302 includes an opening 1304 in the top of the dome-shaped top of the body 1302 to receive a valve handle 1306, which is hinged to the top of the dome-shaped body. FIG. 13C shows a cross-sectional view of the dispenser 1300 along a line F-F, shown in FIG. 13A. FIG. 13C reveals the rounded base 1308 of the handle 1306 contacts a pin 1310 that extends to a flexible support arm 1312 that, in turn, is connected to the stopper 208. In other words, the handle 1306 is operated like a lever to move the stopper 208 in and out of the narrow opening 222. FIG. 13C also reveals a spring 1314 loaded button 1316 that includes an aim 1318 that extends through the handle 1306 to a clasp 1320 exposed through a recessed opening 1322 in the base of the handle 1306. In the example of FIG. 13A-13C, the dispenser 1300 also includes a hinged blade switch 1324 that includes two blades 1326 and 1328 that cover openings that lead to channels located within the body wall as described above with reference to FIG. 10B. The switch 1324 includes an arm 1330 that is hinged to the body 1302 and shares approximately the same pivot axis as the handle 1306.

Figure 14C:
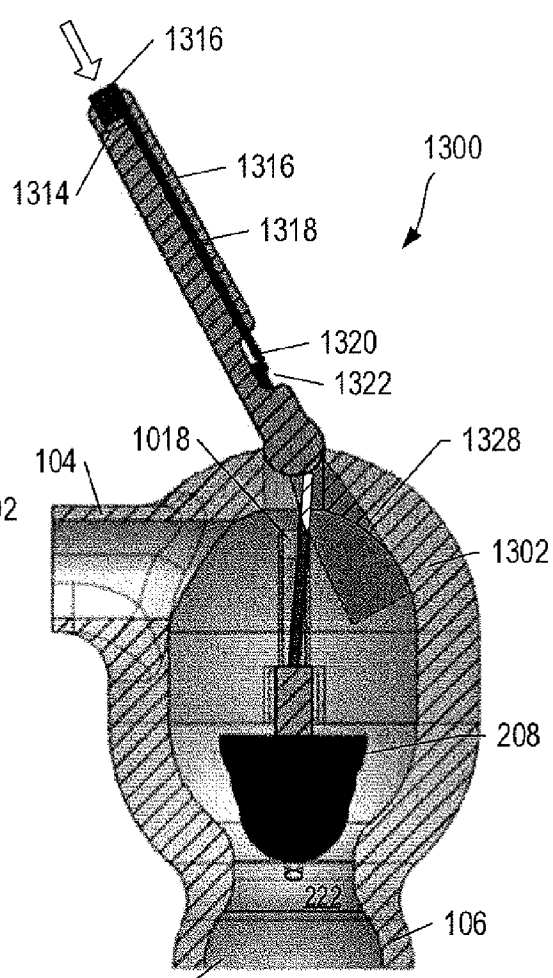
FIGS. 14A-14C show three views of the example liquid-conditioning dispenser shown in FIGS. 13A-13C with the aeration switch activated.
Figure 14B:
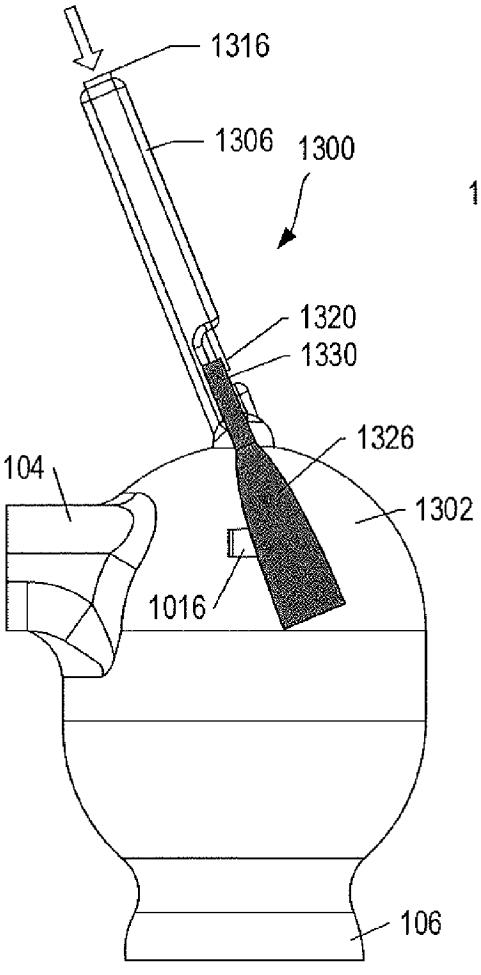
Figure 14A:
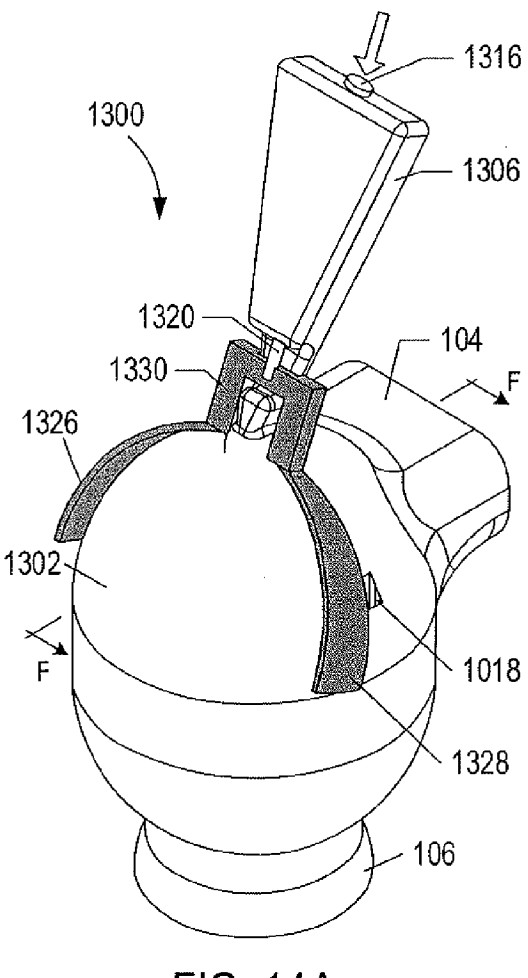

In the example of FIGS. 13A-13C, the handle 104 is moved toward the tap connector 104 without depressing the button 1316. The base 1308 moves the pin 1310 away from a vertical position, which elevates the stopper 208 and allows a liquid to exit through the spout opening 206 as described above. Because the button 1316 is not depressed, the clasp 1320 does not grab the arm 1330 and the blades 1326 and 1328 cover the openings 1016 and 1018 that lead to the channels 1012 and 1014 shown in FIG. 10. When the button 1316 is not depressed, the handle can be moved either forward or backward to dispense the liquid. On the other hand, FIGS. 14A-14C show isometric, side elevation, and cross-sectional views of the example liquid-conditioning dispenser 1300 with the button 1316 depressed and the handle pushed toward the tap connector 104. As a result, the clasp 1320 grabs the arm 1330 and the switch 1324 is rotated so that the blades 1326 and 1328 uncover the openings 1016 and 1018 to allow air to flow through the channels 1012 and 1014 to the narrow opening 222.

Figure 15:
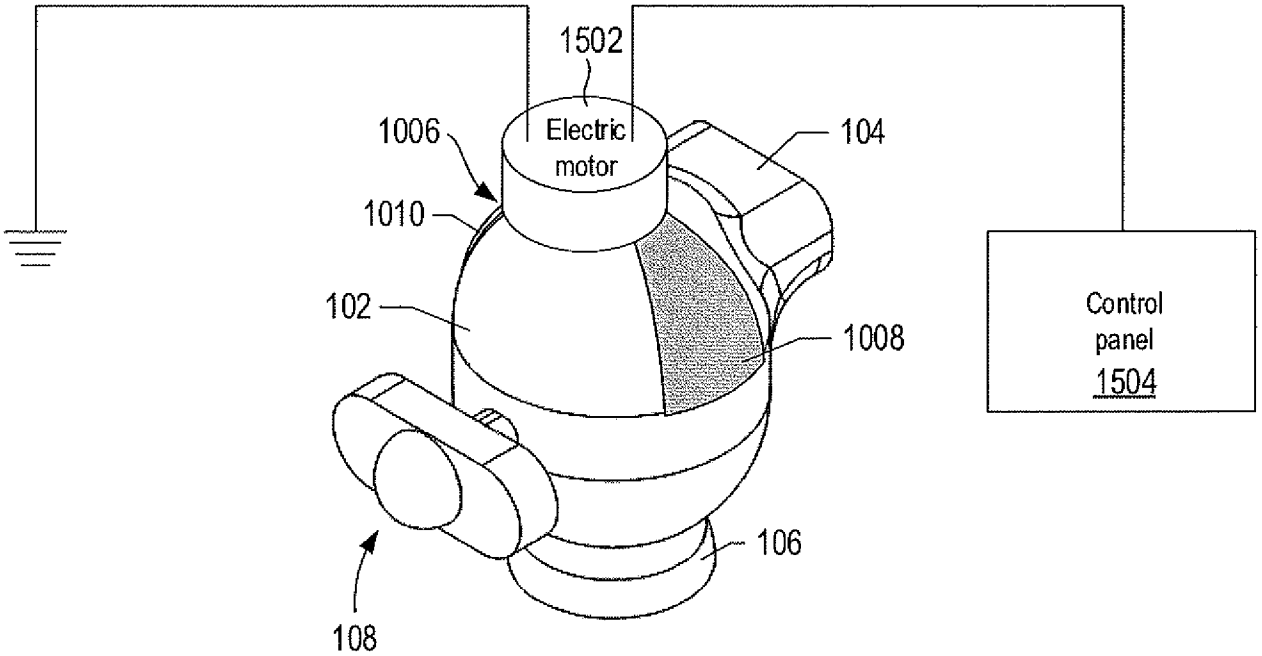
FIG. 15 shows an isometric view of an example liquid-conditioning system with an electronically operated blade switch.

Integrated aeration systems can also be electronically controlled. FIG. 15 shows an isometric view of the liquid-conditioning system 1000 with an electronic motor 1502 attached to the body 1002 and the rotatable blade switch 1006. The motor 1502 is connected to a control panel 1504 and a ground 1506. The control panel 1504 supplies power and can includes buttons, dials, or a graphical user interface that can be used to control operation of the motor 1502 to rotate the switch 1006 as described above with reference to FIG. 10.

The liquid-conditioning dispensers and aeration switches described above can be made of a suitable plastic, metal, hard rubber, wood, glass, or any other material that retains a defined shape. The liquid-conditioning dispensers can be fabricated using injection molding, carving, 3D printing, and laser cutting.

Figure 16:
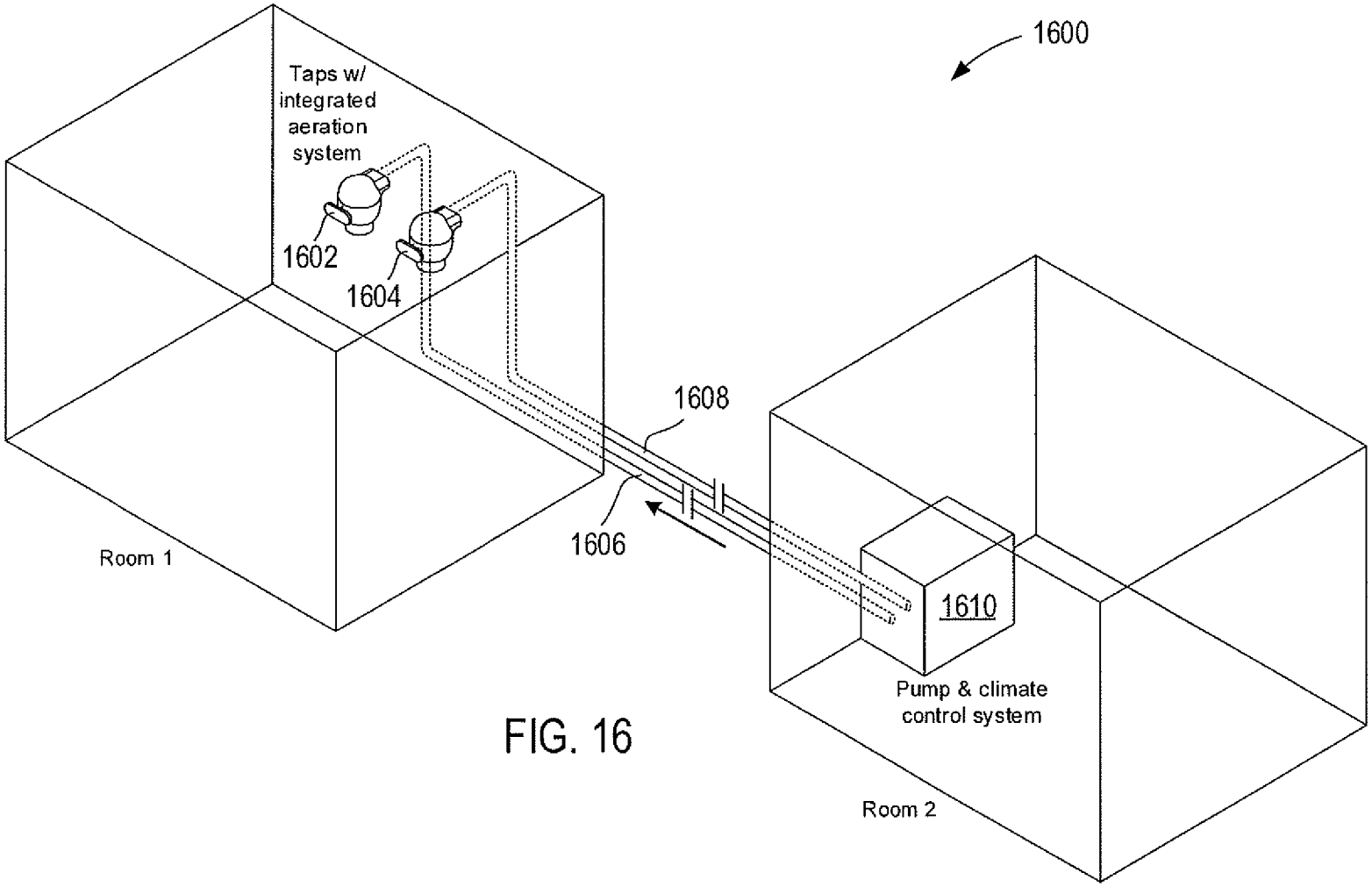
FIG. 16 shows an example representation of a liquid-dispensing system.

Liquid-conditioning dispensers can be connected to pump and climate control systems to form a liquid-dispensing system. FIG. 16 shows an example representation of a liquid-dispensing system 1600 composed of two liquid-conditioning dispensers 1602 and 1604 that are connected via separate corresponding supply lines 1606 and 1608 to a pump and climate control system 1610. In the example of FIG. 16, the dispensers 1602 and 1604 are located in a first room identified as Room 1 and the control system 1610 is located in a second room identified as Room 2. In practice, the control system 1610 can also be located in the same room as the dispensers 1602 and 1604 or the Rooms 1 and 2 can be located on the same floor of a building or located on separate floors of a building. The pump and control system 1610 maintains a positive pressure on the liquids to be dispensed at the dispensers 1602 and 1604 so that when the dispensers 1602 and 1604 are engaged to dispense liquids, the liquids flow forcefully through the dispensers 1602 and 1604. When the dispensers 1602 and 1604 are disengaged, the pressure stabilizes and the pump and control system 1610 reverts to stand-by.

Figure 17A:
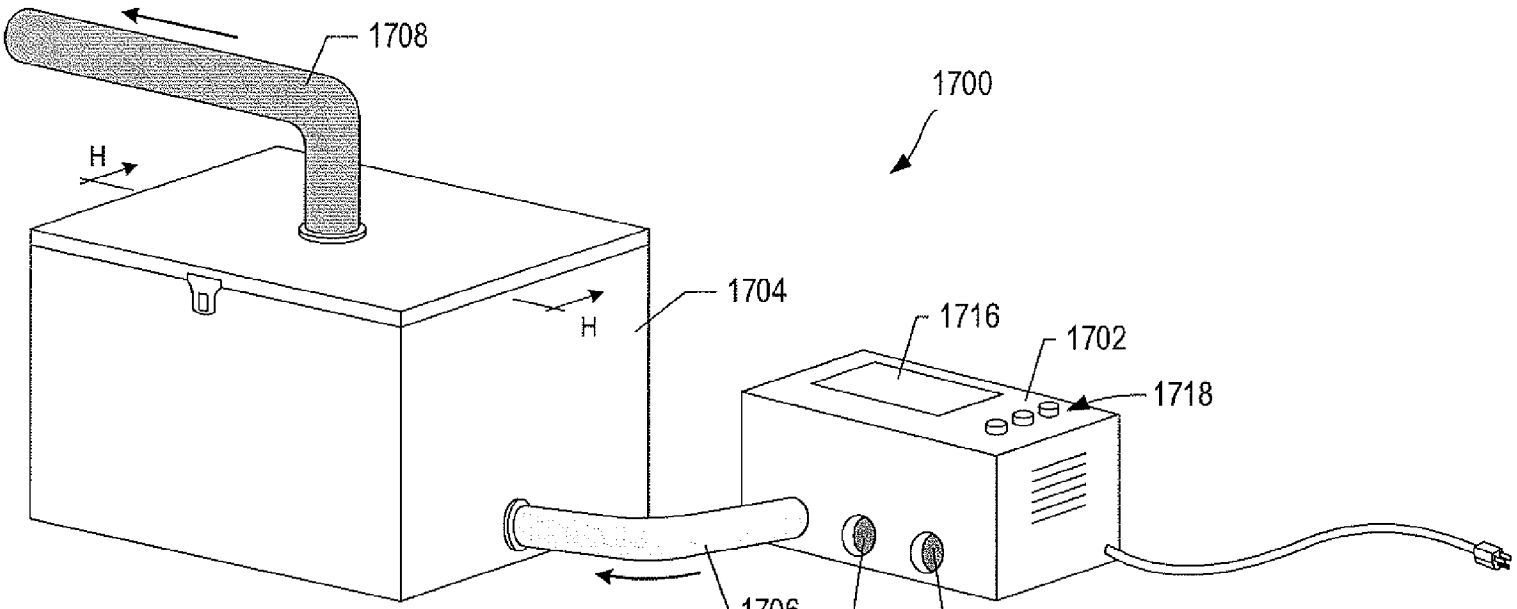
FIG. 17A shows an example of a pump and climate control system connected to a container.
Figure 17B:
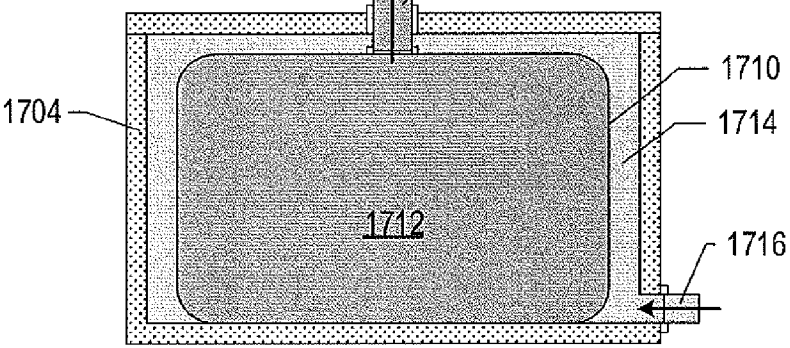
FIG. 17B shows a cross-sectional view of the container shown in FIG. 17A.

FIG. 17A shows an example of a pump and climate control system 1702 connected to an insulated container 1704 via a fluid supply line 1706. A liquid supply line 1708 connects the container 1704 to a liquid-conditioning dispenser (not shown) at the opposite end of the line 1708 as described above with reference to FIG. 16. FIG. 17B shows a cross-sectional view of the insulated container 1704 along a line H-H shown in FIG. 17A and reveals a container 1710 containing a first liquid 1712 stored in the container 1704. The container 1710 is a flexible container, such as a bag composed of plastic or vinyl, and is connected via a liquid-tight seal to the liquid supply line, and the first liquid 1712 contained in the container can be a beverage, such as wine. The control system 1702 pumps a fluid 1714, such as air, a gas, or a second liquid (e.g., water or antifreeze), into the container via the fluid supply line 1706. The fluid 1714 is pumped into the container 1704 with enough pressure to compress the container 1710 and force the first liquid 1712 to flow from the container 1710 into the liquid supply line 1708 and ultimately to the dispenser. The control system 1702 includes a display 1716 and control knobs or buttons 1718 that can be used to monitor and change the pressure and temperature of the fluid 1714. In the example of FIG. 17A, although only one insulated container 1704 is shown connected to the control system 1702, the control system includes two additional ports 1720 and 1722 for connecting two other insulated containers to the control system 1702. In practice, a pump and control system may have any number of ports. The example control system 1702 allows for the pump pressure and temperature of the fluid supplied to each container to be separately controlled and monitored.

Figure 18A:
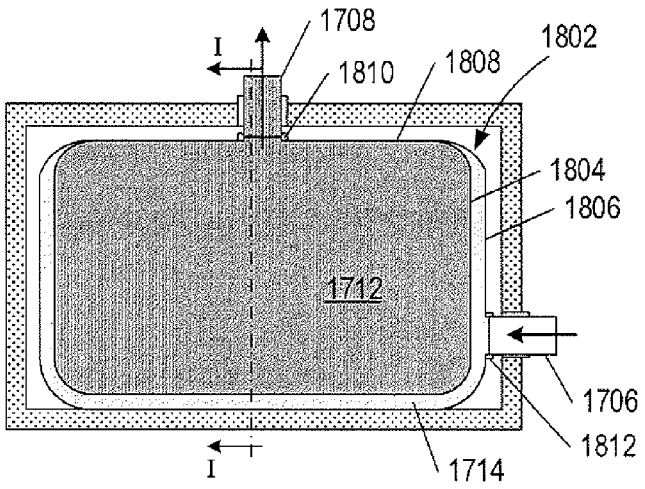
FIG. 18A shows a cross-sectional view of the insulating container shown in FIG. 17B with a container-within-a-container.
Figure 18B:
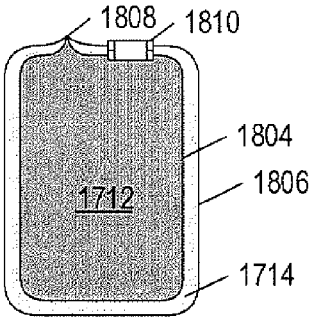
FIGS. 18B-18C show cross-sectional views of the container-within-a-container shown in FIG. 18A.
Figure 18C:
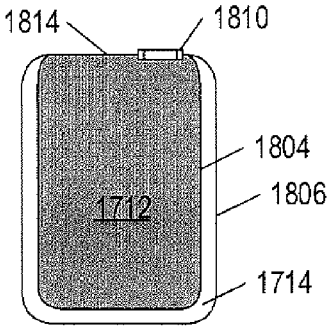

In other embodiments, the container 1710 can be replaced with a container-within-a-container. FIG. 18A shows a cross-sectional view of the insulating container 1704, but with the single container 1710 replaced by a container-within-a-container 1802. FIG. 18B shows a cross-sectional view of a first example container-within-a-container 1802 along a line I-I shown in FIG. 18A. The container-within-a-container 1802 includes an inner container 1804 located entirely within an outer container 1806 with the inner and outer containers connected along a closed seam 1808. The containers 1804 and 1806 can be flexible bags composed of plastic or vinyl. The inner container 1804 contains the first liquid 1712 to be dispensed through the dispenser, and the outer container 1806 is larger than the inner container 1804 in order to create a space between the inner and outer containers. As a shown in FIG. 18B, a first connector 1810 creates an opening through the outer container 1806 into the inner container 1804 and is connected to the second line 1708, as shown in FIG. 18A. FIG. 18A shows a second connector 1812 that connects the outer container 1806 to the fluid supply line 1706. In the example of FIG. 1 SB, the first connector 1810 forms a liquid-tight seal with both the inner and outer containers to prevent the first liquid 1712 from leaking from the inner container 1804 into the outer container 1806 and prevent the fluid 1714 injected into the outer container 1806 from leaking into the inner container 1804. FIG. 18C shows a cross-sectional view of a second example container-within-a-container 1802 along the line G-G shown in FIG. 18A. The container shown in FIG. 18C is similar to the container shown in FIG. 18B except the inner container 1804 and the outer container share a common surface 1814 rather than a seam. In this example, the control system 1702 pumps the fluid 1714 via the fluid supply line 1706 into the outer container 1806 with enough pressure to compress the inner container 1804 and force the first liquid 1712 to flow into the liquid supply line 1708 and ultimately to the dispenser with constant pressure. In other embodiments, the containers share a common surface 1814. In still other embodiments, the inner container 1804 lies entirely within the outer container 1806 and the containers do not share a common seam or surface.

Figure 19:
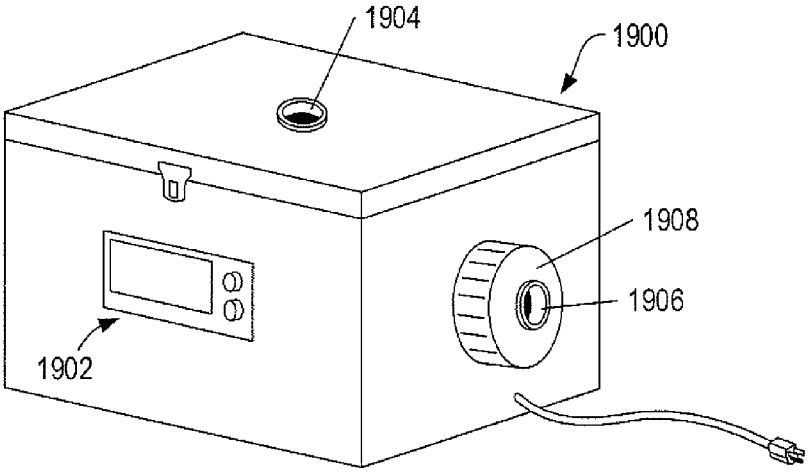
FIG. 19 shows an isometric view of an insulating container with a built-in pump and climate control system.

In other embodiments, the pump and climate control system can be built into the insulated container. FIG. 19 shows an isometric view of an insulated container 1900 with a built-in pump and climate control system. The container 1900 includes a display and control panel 1902, an output port 1904 to be connected to a supply line that leads to a liquid-conditioning dispenser, an input port 1906 to be connected to a fluid supply line, and a pressure pump and refrigeration unit 1908. The input and output ports can be connected to the connectors 1810 and 1812 of the container 1802 which contains the first liquid 1712 in the inner container 1804 as described above with reference to FIG. 18. A fluid such as air or a second liquid is supplied via the supply line connected to the port 1906 and the pump and refrigeration unit 1908 pumps the fluid into the outer container 1806 with enough pressure to compress the inner container 1804 and force the first liquid 1712 into the supply line connected to output port 1904 and ultimately to the dispenser with constant pressure.

Figure 20:
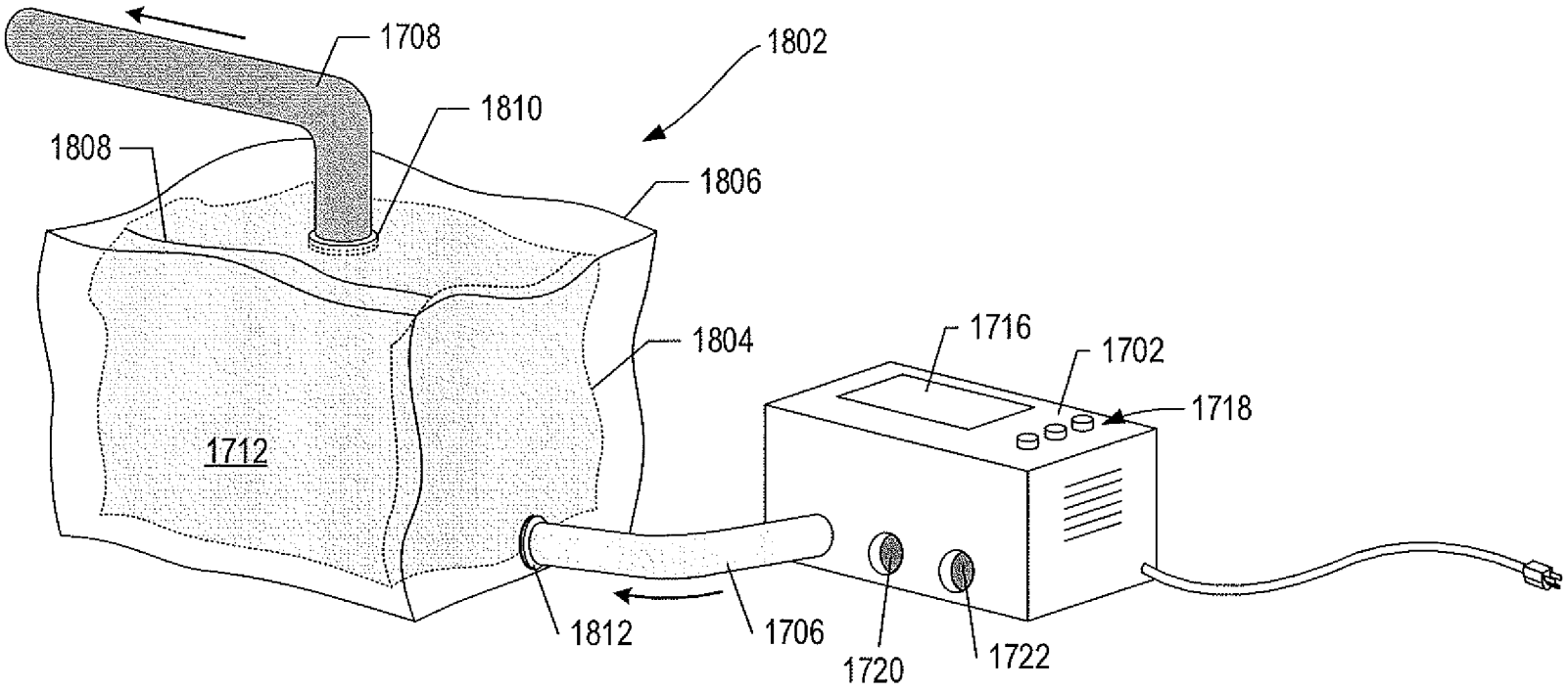
FIG. 20 shows an example of a pump and climate control system connected to a container-within-a-container.

In other embodiments, the insulted container 1704 shown in FIG. 17 can be omitted. FIG. 20 shows the pump and climate control system 1702 connected to the outer container 1806 of the container-within-a-container 1802, shown in FIG. 18, via the fluid supply line 1706. The connector 1810 is connected to the liquid supply line 1708. In this example, the control system 1702 pumps the fluid 1714 via the fluid supply line 1706 into the outer container 1806 with enough pressure to compress the inner container 1804 and force the first liquid 1712 to flow into the liquid supply line 1708 and ultimately to the dispenser with constant pressure. In other embodiments, the fluid 1714 is temperature controlled by the system 1702.

Figure 21A:
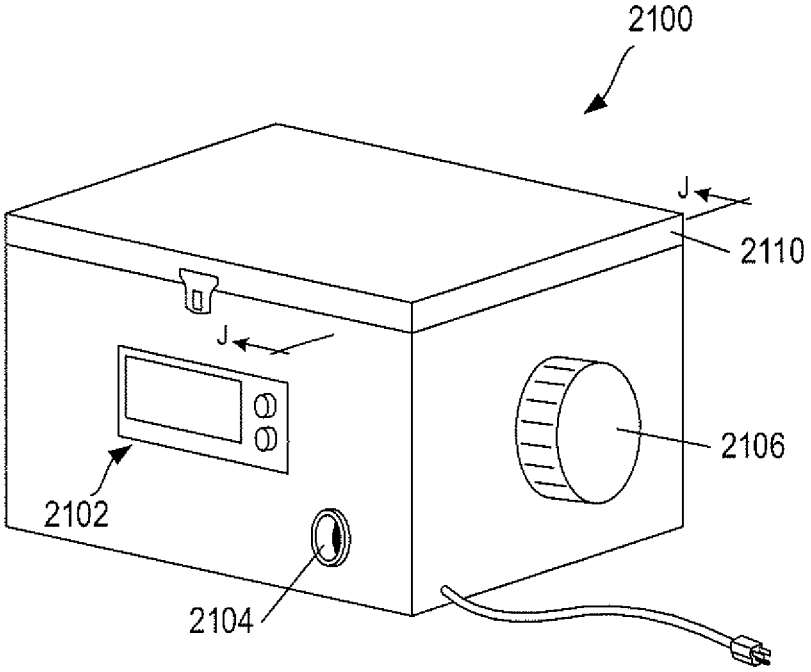
FIG. 21A shows an isometric view of an insulated container with a built-in electro-mechanical pump and a built-in climate control system.
Figure 21B:
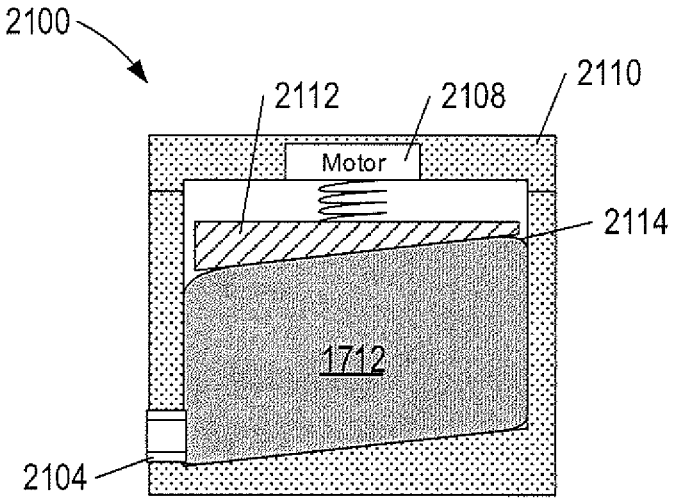
FIG. 21B shows a cross-sectional view of the insulated container shown in FIG. 20A.

Liquid-dispensing systems are not intended to be limited to using a fluid to force a liquid from a container to a liquid-conditioning dispenser. In other embodiments, an electro-mechanical compressor can be used to compress a container and force the liquid contents into a supply line that leads to a liquid-conditioning dispenser with constant pressure. FIG. 21A shows an isometric view of an insulated container 2100 with a built-in electro-mechanical compressor and a built-in climate control system. FIG. 21B shows a cross-sectional view of the container 2100 along a line J-J shown in FIG. 21A. The container 2100 includes a display and control panel 2102, an output port 2104 to be connected to a supply line that leads to a liquid-conditioning dispenser, and a refrigeration unit 2106. In this example, the cross-sectional view of FIG. 21B reveals an internal electronic drive motor 2108 built into the lid 2110 of the container 2100. The motor 2108 drives a wedge-shaped press 2112 against a container 2114 filled with the liquid 1712, forcing the liquid 1712 into a supply line (not shown) connected to the port 2104.

Although various embodiments have been described, it is not intended that this disclosure be limited to these embodiments. It is appreciated that the above description of the disclosed embodiments is provided to enable any person skilled in the art to make or use the systems described. Various modifications to these embodiments will be readily apparent to those skilled in the art, and the generic principles defined herein may be applied to other embodiments without departing from the spirit or scope of the disclosure. Thus, the present disclosure is not intended to be limited to the embodiments shown herein but is to be accorded the widest scope consistent with the principles and novel features disclosed herein.

The invention claimed is:

1. A liquid-conditioning dispenser comprising:

a tap including a tap connector, a body with a cavity and a spout, the cavity to direct a liquid input to the tap connector to flow out through the spout; and an aeration system integrated with the body, the aeration system includes:

one or more channels located within a wall of the body, each channel having a first opening and a second opening, the first opening located in an exterior surface of the body and the second opening located between the cavity and the spout, each channel having an upper channel and a lower channel wherein the upper and lower channels are aligned and separated by a rotatable open-ring aeration switch located within a slot of the body, the switch having one or more axial vents to regulate flow of the fluid from the one or more upper channels to the one or more lower channels, wherein the switch regulates the flow of the fluid from the first opening to the second opening and regulates an amount of a fluid to mix with the liquid when the liquid flows from the cavity to the spout.

2. The dispenser of claim 1, wherein the tap includes a tap connector with a connector opening that opens into the cavity, the connector opening to receive the liquid and direct the liquid into the cavity.

3. The dispenser of claim 1, wherein the switch has one or more lateral vents to regulate flow of the fluid into the lower channels.

4. The dispenser of claim 1, wherein the aeration switch is a rotatable open-ring switch located within a slot of the body, the switch having one or more vents to regulate flow of the fluid into the one or more channels.

* * * * *